US005474130A

United States Patent [19]

Davis

[11] Patent Number: 5,474,130

[45] Date of Patent: Dec. 12, 1995

[54] PERFORATION PURGING TOOL

[76] Inventor: Thomas C. Davis, P.O. Box 1824, Andrews, Tex. 79714

[21] Appl. No.: 286,666

[22] Filed: Aug. 5, 1994

[51] Int. Cl.[6] ..... E21B 37/00

[52] U.S. Cl. ..... 166/312; 166/222

[58] Field of Search ..... 166/222, 223, 166/312, 902; 175/420

[56] References Cited

U.S. PATENT DOCUMENTS 5,195,585 3/1993 Clemens et al. ..... 166/312 X

*Primary Examiner*—William P. Neuder
*Attorney, Agent, or Firm*—Wendell Coffee

[57] ABSTRACT

A well casing cleaning tool includes a tubular tool body that has a central axial passageway and upper and lower sets of jet ports through the tool body wall. The upper jet ports are angled upward and the lower jet ports are angled downward. The outside diameter of the cleaning tool is slightly smaller than the inside diameter of the well casing to be cleaned. When wash fluid is pumped through the jet ports of the cleaning tool, an area of reduced pressure forms between the upper and lower sets of jet ports. This area of reduced pressure aids in the cleaning of the perforation zone of a well. Bypass passages from above the upper set of jet ports to below the lower set of jet ports prevent a pressure difference between the two sets of jet ports.

15 Claims, 2 Drawing Sheets

PERFORATION PURGING TOOL

BACKGROUND OF THE INVENTION (1) Field of the Invention

The present invention relates to an apparatus and method for cleaning oil wells, and more particularly to the cleaning of an oil well casing's perforation zone. Persons engaged in oil well production have ordinary skill in this art.

(2) Description of the Related Art

In a typical oil well bore from which fluids are produced from an underground formation, a cylindrical well casing is used. A well casing has perforations at one or more production zones through which fluid passes from a formation into the well casing. The flow of desired fluid through the perforations carries with it sediment and chemical contaminants. Over a period of time, sediment and chemical contaminants can clog or plug the perforations, and can also attach to the well casing. The accumulation of matter at the perforation zone and on the well casing causes a loss of production capacity from the well.

Those in the well production business have devised various tools which clean the well bore and the perforation zones.

Some tools use high pressure jets or pressure zones to clean the well bore such as described in U.S. Pat. Nos. 2,918,973 to Ozinga and 5,161,612 to Stafford. Other tools use mechanical means to clean the perforation zone such as described in U.S. Pat. Nos. 4,671,355 to Strange and 4,892,145 to Stafford.

SUMMARY OF THE INVENTION

PROGRESSIVE CONTRIBUTION TO THE ART

A method and tool for cleaning a well bore and the well's perforation zone that employs a reduced pressure zone to aid in the cleaning of the perforation zone is disclosed herein.

I have invented an apparatus and method for cleaning a well bore, including the perforation zone of the well. The cleaning tool consists of a tubular tool body that has a central axial passageway and an outside diameter that is slightly smaller than the inside diameter of the well bore. The tool body has upper and lower sets of jet ports that allow cleaning fluid to pass from the central passageway of the tool body to an area outside of the tool body. When fluid flows through the jet ports, the flow causes an area of reduced pressure to form between the upper and lower sets of ports. This reduced pressure zone assists in the cleaning process.

The cleaning tool has bypasses located in the tool body wall. The bypasses allow a reduced pressure zone to form when one set of jet ports is located next to a section of the well casing that is not perforated while the other set of jet ports is located next to a perforation zone. A sleeve is located in the central passageway of the tool body. The sleeve allows or prevents fluid flow through the jets

OBJECT OF THE INVENTION

An object of this invention is to clean a well bore and casing.

A further object of this invention is to provide a tool capable of cleaning the perforation zones of a well bore and casing.

Further objects are to achieve the above with a device that is sturdy, compact, durable, lightweight, simple, safe, and efficient, yet inexpensive to produce.

Other objects are to achieve the above with a method that is rapid, versatile, ecologically compatible, energy conserving, efficient, and inexpensive, and does not require highly skilled people to operate and maintain.

The specific nature of the invention, as well as other objects, uses, and advantages thereof, will appear from the following description and from the accompanying drawings, the different views of which are not necessarily scale drawings.

Figure 1A:
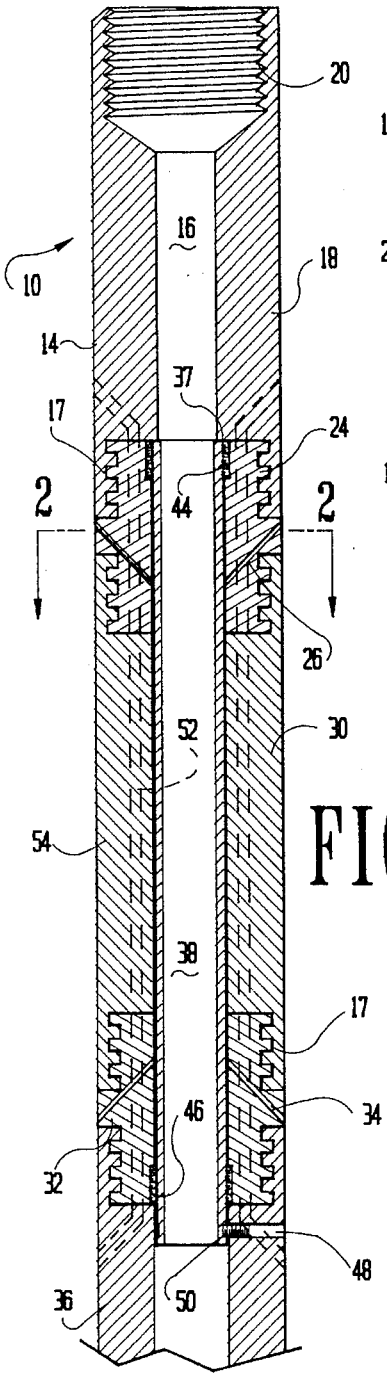
FIG. 1A & B are axial sectional views of an embodiment of the cleaning tool.

As an aid to correlating the terms describing the cleaning tool to the exemplary drawings, the following catalog of elements is provided:

10 cleaning tool
12 well casing
13 perforation
14 tubular tool body
16 axial central passageway
17 acme pipe threads
18 pipe string connection section
20 pipe threads
22 pipe string
24 up-well jet port section
26 up-well jet ports
28 area outside of tool body
30 spacing section
32 down-well jet port section
34 down-well jet ports
36 sleeve spacing section
37 shoulder
38 sleeve
39 shoulder
40 down-well tool connector section
42 drill bit
44 up-well molded seal

46 down-well molded seal
47 bottom molded seal
48 shear screw passageway
50 shear screw
52 bypass
54 tool body wall
56 annulus
58 dart valve
60 O-ring
62 sand line
64 overshot

DESCRIPTION OF THE PREFERRED EMBODIMENTS

Referring more particularly to the drawings, the apparatus for cleaning a well bore of the present invention is indicated by the numeral 10. There are several different types of wells such as gas wells, oil wells, water wells and the like. The cleaning tool can be used in any type of well. Also, there are several types of wash fluids that can be used to clean a well such as water, brine, solvents, and acids. The cleaning tool can be used with these types of wash fluids.

The following discussion is for an oil well. Well casing 12 is a metal tube or pipe cemented in the well bore. A well perforation zone is a portion of the well casing that has holes or perforations 13 through the well casing. The holes allow fluid to flow into and out of a producing formation or zone. Axial directions are given with respect to position in the well bore: up-well being towards the surface of the earth, and down-well being towards the bottom of the well.

The cleaning tool 10 includes tubular tool body 14 that has an axial central passageway 16. The outside diameter of the tool body is slightly smaller than the inside diameter of a well casing 16. It has been found that the clearance between the outside diameter of the tool body and the inside diameter of the well casing should be approximately 1/20 the inside diameter of the well casing. In a typical oil well, the well casing has an inside diameter of 5". The outside diameter of the tool body would be 4½".

Figure 1B:
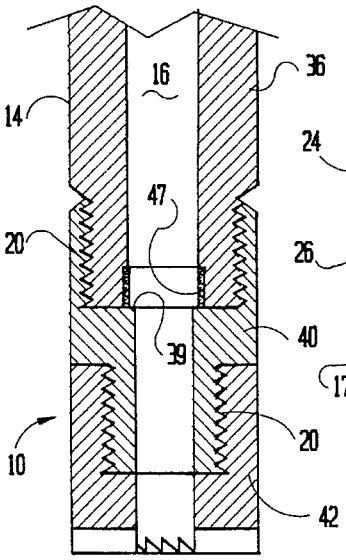
Figure 7:
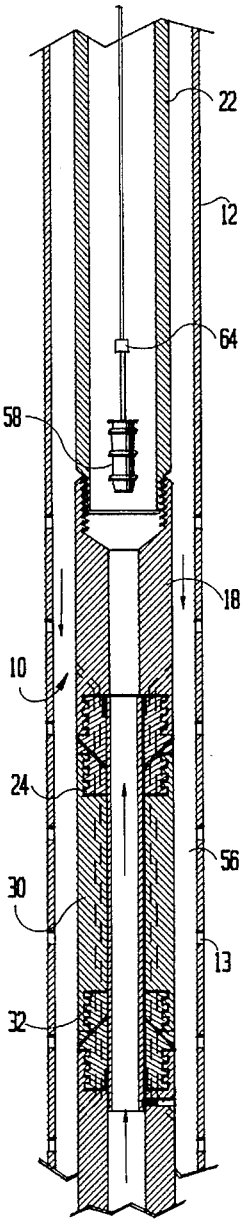
FIG. 7 is an axial sectional view of the cleaning tool with the sleeve in an up-well position, and with the dart valve detached and being withdrawn from the well, illustrating the wash fluid flowing down the annulus.

The tool body 14 is made of six separate sections as is shown in FIG. 1A and FIG 1B. The first five sections are joined together with acme threads 17 so that the sections align properly. The first section is pipe string connection section 18. This section has pipe threads 20 at its up-well end so that it can be attached to a well pipe string 22 as shown in FIG. 7.

Figure 8:
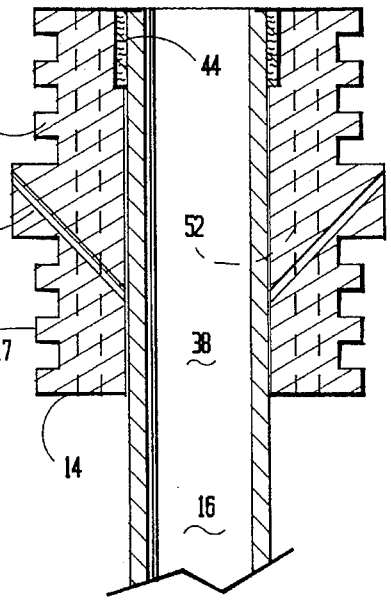
FIG. 8 is a detail of a portion of the cleaning tool and the sleeve.
Figure 3:
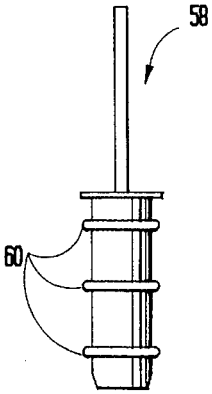
FIG. 3 is a side elevational view of a dart valve.
Figure 2:
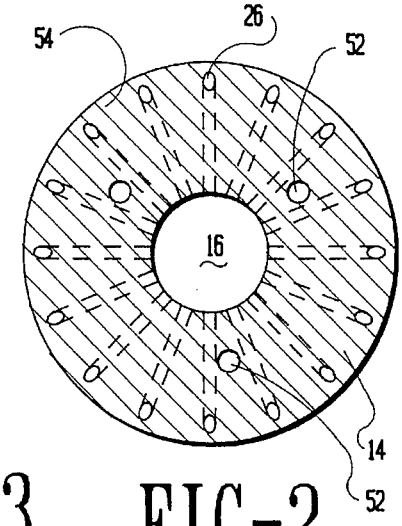
FIG. 2 is a cross sectional view taken substantially on line 2—2 of FIG. 1.

The second section is an up-well jet port section 24 which is threaded to the pipe string connection section 18. A detail of this section is shown as FIG. 8. The up-well jet port section contains a set of up-well jet ports 26. The up-well set of jet ports consists of sixteen 3/16" holes drilled through the up-well jet port section. The jet ports are evenly spaced about the circumference of the section. The jet ports permit fluid flow from the central axial passageway 16 to an area 28 outside of the tool body, which is the annulus 56 when in use. The jet ports are drilled through the section at about 45° angles with respect to the well bore's central axis. The angles are oriented so that fluid flow from the central axial passageway will be directed in an up-well direction.

The third section is the spacing section 30 which is threaded to the up-well jet port section 24. The spacing section provides space between the up-well jet port section and a down-well jet port section 32.

The fourth section is the down-well jet port section 32 which is threaded to the spacing section 30. This section contains a set of down-well jet ports 34. The down-well set of jet ports consists of sixteen 3/16' holes drilled through the down-well jet port section. The holes are evenly spaced about the circumference of the down-well jet port section. The jet ports permit fluid flow from the central axial passageway 16 to an area 28 outside of the tool body. The jet ports are drilled through the section at about 45° angles with respect to the well bore's central axis. The angles are oriented so that fluid flow from the central axial passageway will be directed in a down-well direction.

The fifth section is a sleeve spacing section 36 which is threaded to the down-well jet port section 32. The sleeve spacing section provides space for a sleeve 38 to fit in the central axial passageway 16 without blocking the jet ports 26, 34. The sleeve spacing section has pipe threads 20 at its down-well end.

The sixth section is a down-well tool connector section 40 which is threaded to the sleeve spacing section 36. The down-well tool connector section has pipe threads 20 at its down-well end so that an additional tool, such as a drill bit 42, can be attached to the cleaning tool 10 to aid in the cleaning of the interior of the well casing 12.

The sleeve 38 is located in the central axial passageway 16 of the cleaning tool 10. The sleeve blocks both sets of jet ports 26, 34 when the sleeve is in an up-well position. The sleeve allows fluid to flow through the jet ports when the sleeve is in a down-well position.

The sleeve 38 is able to slide in the central axial passageway 14. The range of motion that the sleeve can slide is limited by a shoulder or ledge 37 on the pipe string connection section 18, and by a shoulder or ledge 39 on the sleeve spacing section 36. The inside diameters of both the pipe string connection section and the sleeve spacing section are smaller than the outside diameter of the sleeve, thus limiting the sleeve's upward and downward ranges of motion.

An up-well molded seal 44 in the top of the up-well jet port section 24 and a down-well molded seal 46 in the bottom of the down-well jet port section 32 support the sleeve 38 in the sleeve's up-well position. The seals also prevent fluid from bypassing the sleeve when the sleeve is in its up-well position.

When the sleeve 38 is in a down-well position, the down-well molded seal 46 and a bottom molded seal 47 in the bottom of the sleeve spacing section 36 support the sleeve and prevent fluid from bypassing around the sleeve.

The sleeve spacing section 36 has a shear screw passageway 48. A shear screw 50 is used to support the sleeve 38 in its up-well position while the cleaning tool 10 is initially being lowered down a well.

Three bypasses 52 are located in the tool body wall 54. The bypasses extend through the top five sections 18, 24, 30, 32, and 36. The acme threads 17 will makeup the sections so the bypasses 52 in each section will connect with the bypasses in the connecting section. The bypasses form means for equalizing the pressure above the upper set of jet ports 26 and below the down-well set of jet ports 34. The bypasses maintain an area of reduced pressure between the up-well and down-well sets of jet ports 26, 34 when one set of jet ports is next to a perforation zone while the other set of jet ports is next to a section of the well casing 12 that is not perforated. For example, if the cleaning tool is positioned at the top of a perforation zone so that the up-well set of jet ports will discharge fluid next to the well casing and the lower set of jet ports will discharge into the perforation zone, the flow from the up-well set of jet ports will flow through the bypasses to below the down-well set of jet ports. This will cause an area of reduced pressure to form between the up-well set of jet ports and the down-well set of jet ports. When both the up-well and down-well sets of jet ports discharge into a perforated section of the well casing, there is little or no flow through the bypasses because there is no pressure differential between the exits of the bypasses The cross sectional area of the bypasses 52 is approximately equal to the cross sectional area of the jet ports 26, 34. For example, if there are 32⅜' jet ports (cross sectional area =3.5 sq in), there would be 3⅝" bypasses (cross sectional area =3.7 sq in). Prior to the machining of the cleaning tool, if it is seen that the bypasses would intersect the jet ports, then the number of bypasses can be increased and the diameter of the bypasses decreased.

Figure 4:
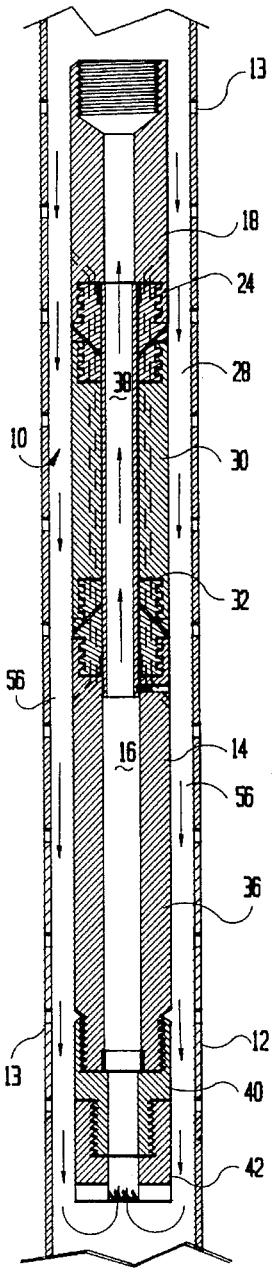
FIG. 4 is an axial sectional view of the cleaning tool within a well casing illustrating a wash fluid flowing down the annulus.

To use the cleaning tool 10, the sleeve 38 is positioned in its up-well position, and a shear screw 50 is positioned in the shear screw passageway 48 to ensure that the sleeve will remain in position when the cleaning tool is lowered down the well. The cleaning tool is attached to the well's pipe string 22 and lowered down the well. The well bore, or just the perforation zone, may be cleaned from top to bottom by pumping wash fluid down the annulus 56 between the tool body 14 and the well casing 12 while lowering the cleaning tool down the well bore. The drill bit 42 may be used to aid in cleaning out the bottom of the well. Return flow would go back up the central passageway 16 of the cleaning tool and the pipe string. This is illustrated in FIG. 4.

To clean the perforation zone, the cleaning tool 10 is positioned in the perforation zone, preferably at the top or bottom of the perforation zone. A dart valve 58 is dropped into the pipe string 22 and pumped down to the cleaning tool. The dart valve's O-rings engage the sleeve 38 and the sleeve is pushed downwards, shearing the shear screw 50. The dart valve repositions the sleeve into the sleeve's down-well position. In this position, the jet ports 26, 34 are open, and the central axial passageway 16 of the cleaning tool is blocked by the dart valve.

Figure 5:
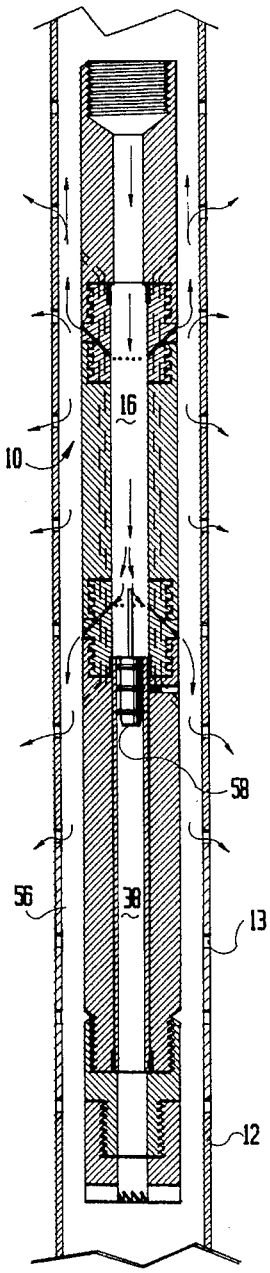
FIG. 5 is an axial sectional view of the cleaning tool within the well casing showing the sleeve in a down-well position, and with the central axial passageway blocked by a dart valve, illustrating the wash fluid flowing from the jet ports into the perforation zone.

Next, wash fluid is pumped down the pipe string 22, while the cleaning tool 10 is moved up or down the well bore, depending on the cleaning tool's position in the well. The fluid flow passes through the cleaning tool's jet ports 26, 34. The orientation of the up-well and down-well sets of jet ports causes the formation of an area of reduced pressure between the two sets of jet ports. The area of reduced pressure aides in loosening and carrying away of particulate matter from the perforation zone. The cleaning fluid would flow through the perforations 13 into the formation above and below the jet port sections. Then the cleaning fluid flows back through the perforations 13 into the annulus 56 at the reduced pressure area between the jet port sections. This is illustrated in FIG. 5.

The cleaning tool 10 can be repositioned to the top or bottom of the perforation zone and a different washing fluid can be used to wash the perforation zone.

Figure 6:
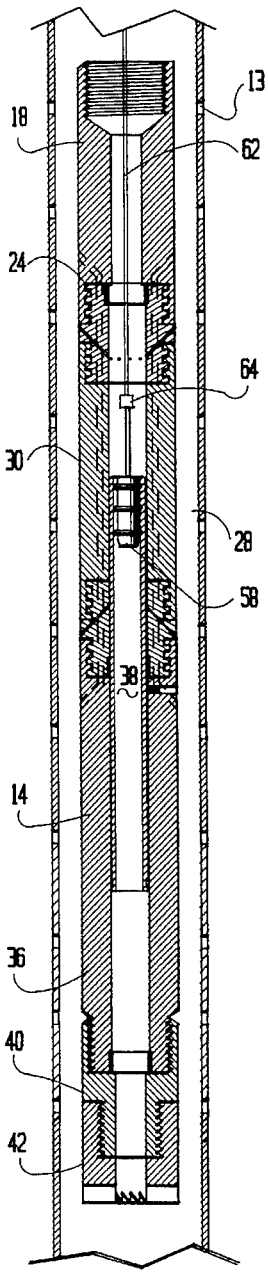
FIG. 6 is an axial sectional view of the cleaning tool within the well casing showing the sleeve being raised by a sand line attached to the dart valve.

After the perforation zone has been cleaned, a sand line 62 is dropped down the pipe string 22. Overshot 64 on the sand line attaches to the dart valve 58. Then, the sand line is used to position the sleeve 38 in its up-well position and to remove the dart valve 58 from the well bore. This is illustrated in FIG. 6.

After the dart valve 58 and sand line 62 have been removed from the well bore, the perforation zone or the whole well bore can be washed from bottom to top by pumping water or brine through annulus 56 While raising the cleaning tool 10. Return flow of wash fluid would be removed through the pipe string 22. This is illustrated in FIG. 7. The drill bit 42 may be used to aid this clean out.

The embodiments shown and described above are only exemplary. I do not claim to have invented all the parts, elements, or steps described. Various modifications can be made in the construction, material, arrangement, and operation, and still be within the scope of my invention.

The restrictive description and drawings of the specific examples above do not point out what an infringement of this patent would be, but are to enable one skilled in the art to make and use the invention. The limits of the invention and the bounds of the patent protection are measured by and defined in the following claims.

Subject matter claimed for protection:

1. A method of cleaning perforations in a well casing with a tubular cleaning tool attached to a well's pipe string, said tool having a central axial passageway and an upper set and a lower set of jet ports, comprising the steps of:

a) positioning the cleaning tool at a perforation zone, b) opening both sets of jet ports, c) closing the axial passageway below the lower set of jet ports, and thereafter d) pumping a wash fluid through the pipe string and tool, thus e) jetting the wash fluid from the jets while f) moving the tool along the perforation zone thus g) creating a reduced pressure area between the upper and lower sets of jet ports.

2. The method as defined in claim 1 comprising the steps of:

h) closing the jet ports of the tool before said positioning step, and then i) lowering said tool to a top of the perforation zone, j) pumping a washing fluid through an annulus between the pipe string and the wall casing, k) lowering the tool through the perforation zone and thereby l) washing the perforation zone by circulating the washing fluid through the annulus and back through the tool and pipe string.

3. The method as defined in claim 1 comprising the further steps of:

h) bypassing wash fluid through the tool from above the upper set of jet ports to below the lower set of jet ports when the upper set of jet ports is located next to the well casing while the lower set of jet ports is located next to the perforation zone, and i) bypassing wash fluid through the tool from below the lower set of jet ports to above the upper set of jet ports when the lower set of jet ports is located next to the well casing while the upper set of jet ports is located next to the perforation zone.

4. The method as defined in claim 1 comprising the further steps of:

h) closing the jets after the above steps, i) opening the axial passageway through the tool, and thereafter j) pumping wash fluid through the annulus between the pipe string and well casing, and k) moving the tool through the perforation zone, l) while the return flow returns up the pipe string.

5. A method of cleaning perforations in a well casing with a tubular cleaning tool attached to a well's pipe string, said tool having a central axial passageway and an upper set and a lower set of jet ports, comprising the steps of:

a) closing the jet ports of the tool, b) lowering said tool to atop of a perforation zone, c) pumping a washing fluid through an annulus between the pipe string and the well casing, d) lowering the tool through the perforation zone and thereby e) washing the perforation zone by circulating the washing fluid through the annulus and back through the tool and pipe string, then f) opening both sets of jet ports, g) closing the axial passageway below the lower set of jet ports, and thereafter h) pumping a wash fluid through the pipe string and tool, thus i) jetting the wash fluid from the jets while j) moving the tool along the perforated portion of the well casing thus k) creating a reduced pressure area between the upper and lower sets of jet ports;

l) bypassing wash fluid through the tool from above the upper set of jet ports to below the lower set of jet ports when the upper set of jet ports is located next to the well casing while the lower set of jet ports is located next to the perforation zone;

m) bypassing wash fluid through the tool from below the lower set of jet ports to above the upper set of jet ports when the lower set of jet ports is located next to the well casing while the upper set of jet ports is located next to the perforation zone; then n) closing the jets, o) opening the axial passageway through the tool, and thereafter p) pumping wash water or brine through the annulus between the pipe string and well casing, and q) moving the tool through the perforation zone r) while the return flow returns up the pipe string.

6. A cleaning tool, having an up-well end and a down-well end, for cleaning a well bore that has a well casing having an inside diameter, and a portion of said well casing having perforations through the well casing into a producing formation, comprising:

a) a tubular tool body adapted to be inside the well casing, b) said tool body having:

i) a tool body wall with an outside diameter that is slightly smaller than a inside diameter of the well casing, ii) a central axial passageway, iii) an upper set of jet ports, angled upwards, which are separated from iv) a lower set of jet ports, angled downwards, by a v) cylindrical portion of the tool body, and vi) a bypass means for equalizing the pressure from above the upper set of jet ports to below the lower set of jet ports.

7. The cleaning tool as defined in claim 6 wherein the upper set of jet ports are drilled through the tool body at angles that are about 45° with respect to the well bore's central axis and oriented so that fluid flow from the central axial passageway to an area outside of the tool body will be directed up-well, and the lower set of jet ports are drilled through the tube body at angles that are about 45° with respect to the well bore's central axis and oriented so that fluid flow from the central axial passageway to the area outside of the tool body will be directed down-well, 8. The cleaning tool as defined in claim 7 further comprising:

c) a sleeve means located in the central passageway of the tool body for opening and closing both sets of jet ports.

9. The cleaning tool as defined in claim 8 wherein the sleeve means is initially held in an up-well position closing the jet ports by a shear screw which is threaded through the tool body wall.

10. The cleaning tool as defined in claim 7 wherein the clearance between a outside diameter of the tool body and the inside diameter of the well casing is about 1/20 of the inside diameter of the well casing.

11. The cleaning tool as defined in claim 7 wherein the up-well end of the tool is threaded onto a pipe string.

12. The cleaning tool as defined in claim 11 further comprising:

c) an additional tool threaded to the down-well end of the cleaning tool to further aid in cleaning the well bore.

13. The cleaning tool as defined in claim 7 wherein said cleaning tool is inside said casing.

14. A cleaning tool, having an up-well end and a down-well end, for cleaning a well bore that has a well casing having an inside diameter, and a portion of said well casing having perforations through the well casing into a producing formation, comprising:

a) a tubular tool body adapted to be inside the well casing;

b) said tool body having:

i a tool body wall with an outside diameter that is slightly smaller than the inside diameter of the well casing wherein the clearance between a outside diameter of the tool body and the inside diameter of the well casing is about 1/20 of the inside diameter of the well casing, ii a central axial passageway, and iii an upper set of jet ports which are separated from iv a lower set of jet ports by a v cylindrical portion of the tool body;

c) said upper set of jet ports are drilled through the tube body at angles that are about 45° with respect to the well bore's central axis and oriented so that fluid flow from the central axial passageway to a area outside of the tool body will be directed up-well;

d) said lower set of jet ports are drilled through the tube body at angles that are about 45° with respect to the well bore's central axis and oriented so that fluid flow from the central axial passageway to the area outside of the tool body will be directed down-well;

e) said cleaning tool having a sleeve means located in the central passageway of the tool body for opening and closing both sets of jet ports;

f) said sleeve means is initially held in an up-well position blocking the jet ports by a shear screw which is threaded through the tool body wall g) said tool body having a bypass means located in the tool body wall extending from above the upper set of jet ports to below the lower set of jet ports;

h) said cleaning tool is threaded onto a pipe string; and j) an additional tool threaded to the down-well end of the cleaning tool to further aid in cleaning the well bore.

15. The cleaning tool as defined in claim 14 further comprising:

k) said tool having the following sections joined together by acme threads:

i a pipe string connection section threaded to ii an upper jet port section threaded to iii a spacing section threaded to iv a lower jet port section threaded to v a sleeve spacing section, and 1) a down-well tool connector section which is connected to the sleeve spacing section by pipe threads;

m) said cleaning tool having:

i an upper molded seal located above the upper set of jet ports, ii a lower molded seal located below the lower set of jet ports and in concert with the upper molded seal so that the sleeve is seated on the seals when the sleeve is an up-well position, and iii a bottom molded seal located below and in concert with the lower molded seal so that the sleeve is seated on the seals when the sleeve is in a down-well position; and n) a removable dart valve in the sleeve means that blocks the central axial passageway.

* * * * *